US009238921B2

(12) United States Patent
Gupta

(10) Patent No.: US 9,238,921 B2
(45) Date of Patent: Jan. 19, 2016

(54) METHOD AND ARRANGEMENTS RELATING TO FOUNDATION FOR ANTENNA MAST OF WIRELESS COMMUNICATION SYSTEM

(75) Inventor: Arvind Kumar Gupta, Stockholm (SE)

(73) Assignee: TELEFONAKTIEBOLAGET L M ERICSSON (PUBL), Stockholm (SE)

( * ) Notice: Subject to any disclaimer, the term of this patent is extended or adjusted under 35 U.S.C. 154(b) by 0 days.

(21) Appl. No.: 13/322,835

(22) PCT Filed: Nov. 18, 2011

(86) PCT No.: PCT/SE2011/051387

§ 371 (c)(1),
(2), (4) Date: Nov. 28, 2011

(87) PCT Pub. No.: WO2013/074007

PCT Pub. Date: May 23, 2013

(65) Prior Publication Data

US 2014/0237908 A1 Aug. 28, 2014

(51) Int. Cl.
*E04H 12/22* (2006.01)
*H01Q 1/12* (2006.01)

(52) U.S. Cl.
CPC ..... *E04H 12/22* (2013.01); *H01Q 1/1242* (2013.01)

(58) Field of Classification Search
CPC .. E04H 12/22; E04H 12/2238; H01Q 1/1242; E02D 27/42
USPC ..... 52/169.9, 292, 294, 295, 296, 297, 298, 52/299, 414; 248/519, 678, 679; 343/720, 343/874, 878, 890
See application file for complete search history.

(56) References Cited

U.S. PATENT DOCUMENTS

| | | | | | |
|---|---|---|---|---|---|
| 3,500,607 | A | * | 3/1970 | Wilson | 52/699 |
| 4,475,856 | A | * | 10/1984 | Toomingas | 411/33 |
| 4,714,225 | A | * | 12/1987 | Skinner et al. | 248/523 |
| 4,922,264 | A | * | 5/1990 | Fitzgerald et al. | 343/878 |
| 5,531,419 | A | * | 7/1996 | Gustafsson et al. | 248/519 |

(Continued)

FOREIGN PATENT DOCUMENTS

| | | | |
|---|---|---|---|
| WO | 00/15923 | A1 | 3/2000 |
| WO | WO 2013076351 | A1 * | 5/2013 |
| WO | WO 2014012708 | A1 * | 1/2014 |

OTHER PUBLICATIONS

Selected documents from the prosecution history of International Application No. PCT/SE2011/051387, 2013-2014 time frame (18 pages).*

*Primary Examiner* — Rodney Mintz
(74) *Attorney, Agent, or Firm* — Murphy, Bilak & Homiller, PLLC

(57) ABSTRACT

A method of building a foundation, a foundation element (2), and a foundation for an antenna mast of a wireless communication system are provided. The foundation comprises at least three foundation elements (2). Each foundation element (2) comprises an elongated body (4). The elongated body (4) comprising a first end (6). At least one bar (16) extends from the elongated body (4) at the first end (6). An attachment arrangement (18) for the antenna mast is provided on the foundation element (2). The at least three foundation elements (2) are arranged to extend substantially symmetrically from a central portion (24) of the foundation (30). A central concrete portion is cast in the central portion (24) of the foundation (30) to join the at least one bar (16) of each of the three foundation elements (2).

6 Claims, 5 Drawing Sheets

(56) References Cited

U.S. PATENT DOCUMENTS 6,050,038 A * 4/2000 Fey et al. ..... 52/223.7
6,343,445 B1 * 2/2002 Ryan ..... 52/148
6,557,312 B2 * 5/2003 McGinnis ..... 52/296
6,702,522 B2 * 3/2004 Silber ..... 405/229
7,533,505 B2 * 5/2009 Henderson ..... 52/292
8,269,690 B1 * 9/2012 Caruso ..... 343/890
8,302,357 B1 * 11/2012 Nolte ..... 52/294
8,322,093 B2 * 12/2012 Zavitz et al. ..... 52/223.5
8,443,573 B1 * 5/2013 Nolte ..... 52/747.12
8,468,760 B1 * 6/2013 Nolte ..... 52/294
8,677,700 B2 * 3/2014 Fairbairn et al. ..... 52/169.9
9,096,985 B1 * 8/2015 Phuly ..... E02D 27/42
52/297
2002/0023394 A1 2/2002 McGinnis
2004/0131428 A1 7/2004 Henderson
2007/0181767 A1 * 8/2007 Wobben ..... E02D 27/42
248/346.01
2009/0102743 A1 * 4/2009 Hager ..... 343/890
2009/0307998 A1 12/2009 Zavitz et al.
2012/0068039 A1 * 3/2012 Erich et al. ..... 248/519
2013/0227898 A1 * 9/2013 Fairbairn et al. ..... 52/169.9
2014/0237909 A1 * 8/2014 Gupta ..... 52/40
2014/0237913 A1 * 8/2014 Kronz et al. ..... 52/169.9
2015/0159337 A1 * 6/2015 Kellner ..... E01F 9/0117
248/156
2015/0225918 A1 * 8/2015 Phuly ..... E02D 27/42
52/297

* cited by examiner

METHOD AND ARRANGEMENTS RELATING TO FOUNDATION FOR ANTENNA MAST OF WIRELESS COMMUNICATION SYSTEM

TECHNICAL FIELD

The technical field relates to a method of building a foundation for an antenna mast of a wireless communication system, to a foundation element for a foundation of an antenna mast of a wireless communication system, and to a foundation for an antenna mast of a wireless communication system.

BACKGROUND

An antenna mast for a wireless communication system is mounted to a foundation. A common foundation used for masts of a wireless communication system is a slab foundation, wherein the mast bears on a single slab of concrete underlying the entire area of the mast. A way of producing such a foundation is to excavate a hole in, the ground, build a rectangular or square mould in the hole, arrange steel reinforcement bars in the mould, and cast concrete in the mould. The weight of the mast is transferred to the soil through the slab foundation. The slab foundation extends in a horizontal plane at least as much as a footprint of the mast to be supported by the relevant foundation. Depending on the size of the mast, the slab foundation may extend e.g. 5×5 meters in the horizontal plane and may be e.g. 1 meter deep.

The slab foundation requires substantial excavation and concrete casting work to be performed. A considerable amount of concrete has to be produced and cast. Also, when an antenna mast is removed from a site, removing such a large concrete casting may be cumbersome.

SUMMARY

An object of embodiments is to provide a foundation for an antenna mast of wireless communication system which is easier produced than a slab foundation.

According to an aspect, the object is achieved by a method of building a foundation for an antenna mast of a wireless communication system. The foundation comprises at least three foundation elements. Each foundation element comprises an elongated body. The elongated body comprises a first end, a second end and is provided with a first end surface. At least one bar extends from the elongated body at the first end. An attachment arrangement for the antenna mast extends from the first end surface. The method comprises:

- arranging the at least three foundation elements to extend substantially symmetrically from a central portion of the foundation and such that each of the first ends of the at least three foundation elements is arranged at the central portion of the foundation, and
- casting a central concrete portion in the central portion of the foundation to join the at least one bar of each of the three foundation elements.

Since preformed elongated foundation elements are utilized in the foundation and extend from a central portion of the foundation, and furthermore the foundation elements are joined by the cast central concrete portion, a foundation may be produced with a much smaller effort than producing a slab foundation. As a result, the above mentioned object is achieved.

The elongated body of one foundation element has suitably such a length that a built foundation with the first end of the elongated body at the central portion of the foundation has a width extending at least over an area corresponding to a footprint of a relevant antenna mast, i.e. a projection of the antenna mast in an erected position on a horizontal plane. The foundation elements may comprise concrete with reinforcement bars, steel, enforced clay, etc.

According to embodiments the said arranging may comprise:

- placing each of the at least three foundation elements with the first end surfaces facing upwardly. In this manner the antenna mast may be attached to the attachment arrangement of each foundation element.

According to embodiments the elongated body of each of the at least three foundation elements may be provided with a through hole extending through the first end surface. The method may comprise:

- driving one pile for each foundation element into a ground portion below the foundation, the said arranging may comprise:
- positioning each pile to extend through each through hole of the at least three foundation elements, and the method may further comprise:
- securing each pile in each through hole. In this manner the foundation may be safely anchored to the ground via the piles.

According to embodiments the method may comprise:

- expanding each pile after it has been driven into the ground portion. In this manner each pile may be safely anchored in the ground.

According to a further aspect, the object is achieved by a foundation element for a foundation of an antenna mast of a wireless communication system comprising an elongated body. The elongated body comprises a first end, a second end and is provided with a first end surface. At least one bar extends from the elongated body at the first end. An attachment arrangement for an antenna mast to be supported by the foundation extends from the first end surface. The elongated body is provided with a through hole extending through the first end surface.

Since the elongated foundation element is provided with at least one bar extending from the elongated body which may be utilized in the foundation to join the foundation element with further foundation elements by a cast central concrete portion, a foundation may be easily produced with a smaller effort than a slab foundation. As a result, the above mentioned object is achieved.

According to embodiments, the elongated body may comprise concrete and reinforcement bars. The at least one bar may be a reinforcement bar. In this manner an easily produced inexpensive and durable foundation element may be provided. Furthermore, such foundation elements may be prefabricated and transported to a site where an antenna mast is to be erected.

According to embodiments the through hole may extend substantially in parallel with a second end surface through the elongated body. The second end surface may be substantially perpendicular to the first end surface. In this manner an anchoring device may be provided through the foundation element to secure the foundation element to the ground.

According to embodiments the attachment arrangement may be secured in the elongated body. In this manner a fixed arrangement may be provided for securing an antenna mast to the foundation element.

The attachment arrangement for instance, may be a threaded steel shaft protruding from the first end surface and being cast into the elongated body.

According to a further aspect, the object is achieved by a foundation for an antenna mast of a wireless communication system comprising at least three foundation elements according to any one of the aspects or embodiments discussed herein. The at least three foundation elements are arranged to extend substantially symmetrically from a central portion of the foundation. Each of the first ends of the at least three foundation elements are arranged at the central portion of the foundation. The at least one bar of the at least three foundation elements are joined by a central concrete portion.

Since the foundation comprises preformed elongated foundation elements, which extend from a central portion of the foundation and the foundation elements are joined by the cast central concrete portion, a foundation may be produced with a much smaller effort than producing a slab foundation. As a result, the above mentioned object is achieved.

According to embodiments a pile may extends through each through hole of the at least three foundation elements and each pile is secured in each through hole by a concrete filling. In this manner the foundation may be anchored to the ground to provide a stable foundation for an antenna mast.

According to embodiments at least one pile may be an expandable steel pile.

In this manner the foundation may be fastened in the ground by expanding the steel pile, which in turn ensures a safe anchoring to the ground.

Further features and advantages will become apparent when studying the appended claims and the following detailed description. Those skilled in the art will realize that different features may be combined to create embodiments other than those described in the following, without departing from the scope as defined by the appended claims.

BRIEF DESCRIPTION OF THE DRAWINGS

The various aspects of embodiments, including its particular features and advantages, will be readily understood from the following detailed description and the accompanying drawings, in which.

DETAILED DESCRIPTION

Embodiments will now be described more fully with reference to the accompanying drawings, in which example embodiments are shown. Disclosed features of example embodiments may be combined as readily understood by one of ordinary skill in the art. Like numbers refer to like elements throughout. Well-known functions or constructions will not necessarily be described in detail for brevity and/or clarity.

Figure 1:
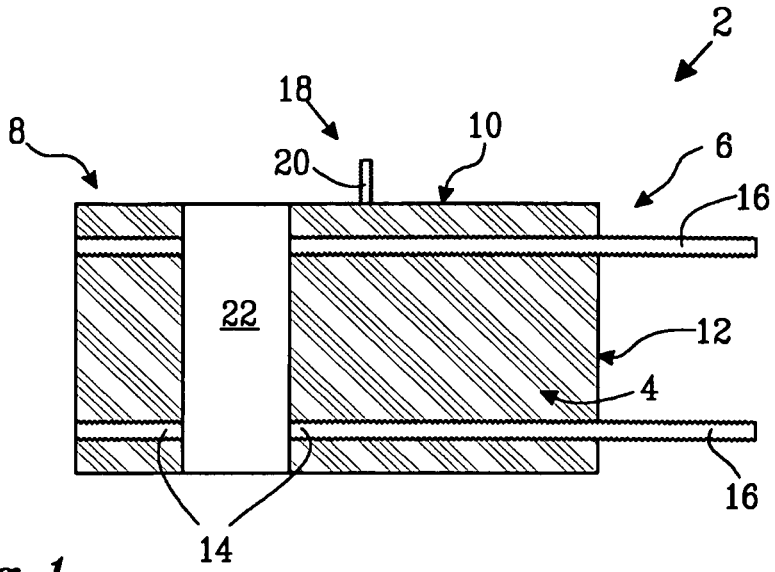
FIG. 1 illustrates a foundation element for a foundation of an antenna mast of a wireless communication system according to embodiments, FIGS. 2*a* and 2*b* each illustrate three foundation elements for foundations of antenna masts of wireless communication systems according to embodiments.

FIG. 1 illustrates a foundation element 2 for a foundation of an antenna mast of a wireless communication system according to embodiments. The foundation element 2 comprises an elongated body 4. The elongated body 4 comprises a first end 6 and a second end 8. The elongated body 4 is provided with a first end surface 10 and a second end surface 12. The foundation element 2 is cast from concrete and comprises reinforcement bars 14. At least one bar 16 extends from the elongated body 4 at the first end 6 of the elongated body 4. The at least one bar 16 extending from the first end 6 is a reinforcement bar extending from the second end surface 12. An attachment arrangement 18 for an antenna mast to be supported by the foundation extends from the first end surface 10. The attachment arrangement 18 comprises at least one threaded shaft 20, which is cast into the concrete of the elongated body 4. The elongated body 4 is provided with a through hole 22 extending through the first end surface 10. The through hole 22 may be arranged at the second end 8 of the elongated body 4 and may extend substantially in parallel with the second end surface 12.

Figure 2A:
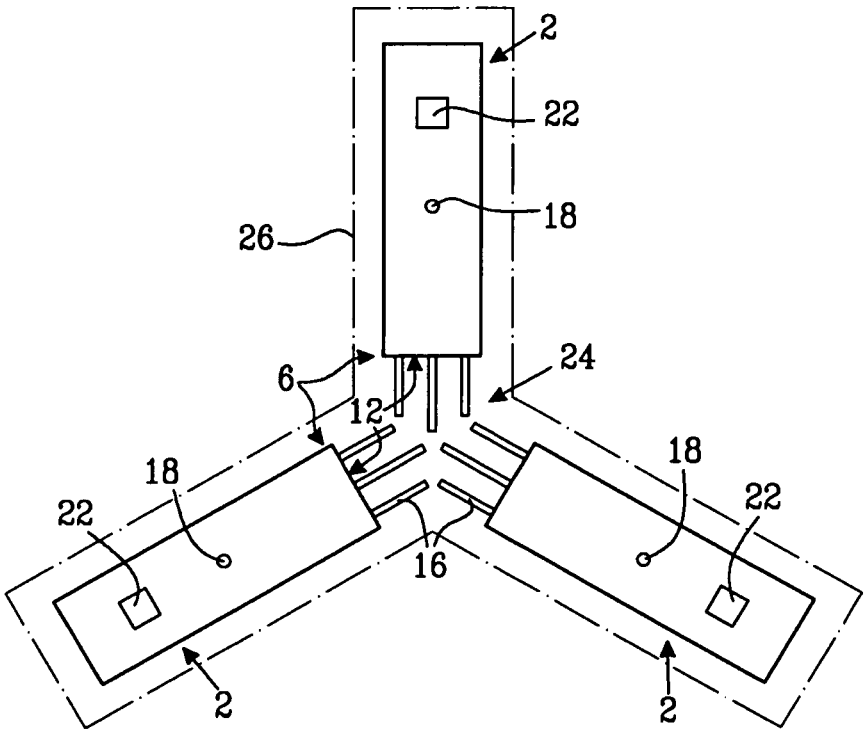

FIG. 2*a* illustrates three foundation elements 2 for a foundation of an antenna mast of a wireless communication system according to embodiments. The three foundation elements 2 each comprise an elongated body 4 and are arranged extending substantially symmetrically from a central portion 24 of the foundation. Each foundation element 2 has a first end 6 with a second end surface 12, from which second surface 12 at least one bar 16 extends.

A pit 26 has been excavated in the ground to accommodate the three foundation elements 2. The foundation elements 2 are arranged in the pit 26 with the first ends 6 at the central portion 24. At the central portion 24 a central concrete portion of the foundation is arranged to be cast. Thus, the at least one bars 16 of the three foundation elements 2 will be joined by a central concrete portion. The foundation will thus comprise the three foundation elements 2 and the central concrete portion. The pit 26 is filled up with soil against the foundation elements 2 and the central concrete portion.

Each foundation element 2 is provided with a through hole 22 extending substantially vertically through the elongated body 4. Each foundation element 22 may be anchored to the ground via its through hole 22. The foundation elements 2 are provided with attachment arrangements 18. An antenna mast may be attached to the foundation via the attachment arrangements 18.

Figure 2B:
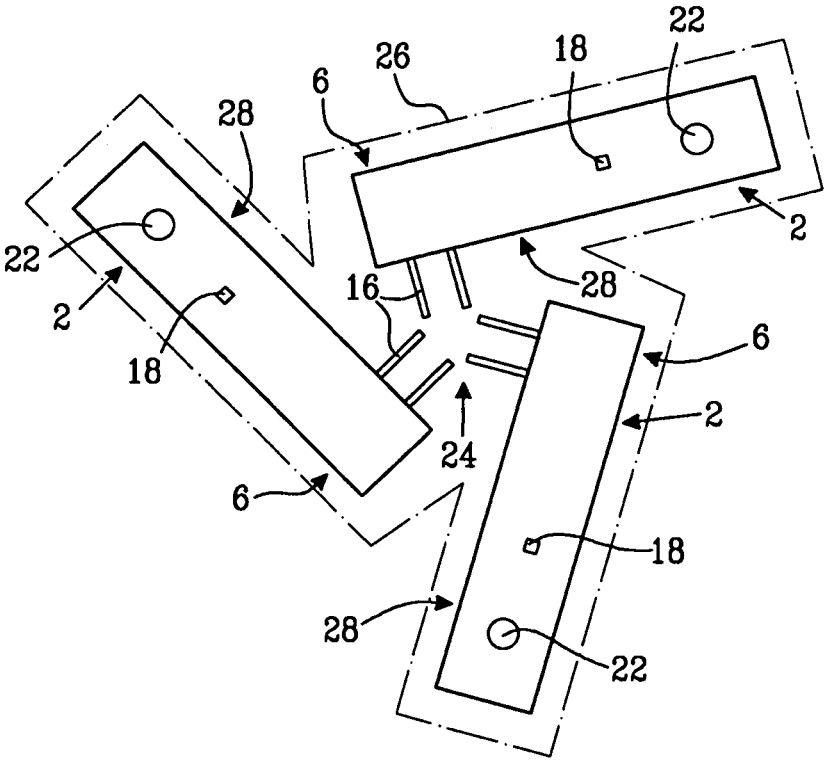

FIG. 2*b* illustrates three foundation elements 2 for a foundation of an antenna mast of a wireless communication system according to embodiments. The three foundation elements 2 each comprise an elongated body 4 and are arranged extending substantially symmetrically from a central portion 24 of the foundation. Each foundation element 2 has a first end 6, at which end at least one bar 16 extends. In contrast to the FIG. 2*a* embodiments, the at least one bar 16 extend from a longitudinal side surface 28 of the elongated body 4 of each foundation element 2 instead of from a second end surfaces.

Again a pit 26 accommodates the three foundation elements 2. The foundation elements 2 are arranged in the pit 26 with the first ends 6 at the central portion 24. At the central portion 24 a central concrete portion of the foundation is arranged to be cast. Thus, the at least one bars 16 of the three foundation elements 2 will be joined by a central concrete portion. Each foundation element 2 is provided with a through hole 22 and is provided with an attachment arrangement 18. An antenna mast may be attached to the foundation via the attachment arrangements 18.

Figure 3:
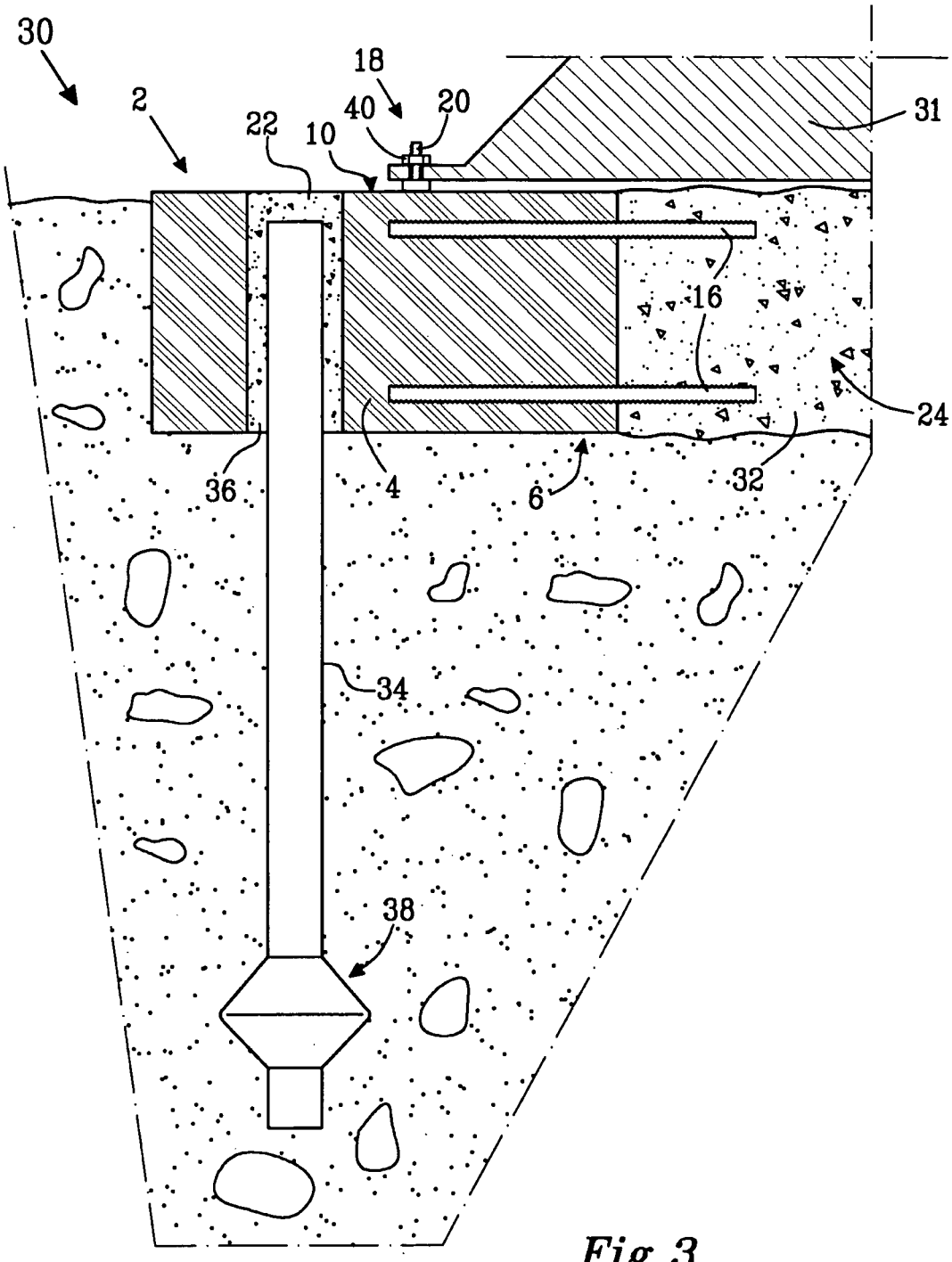
FIG. 3 illustrates a cross section through a portion of a foundation for an antenna mast of a wireless communication system.

FIG. 3 illustrates a cross section through a portion of a foundation 30 for an antenna mast 31 of a wireless communication system. The foundation 30 comprises at least three foundation elements 2 joined at a central portion 24 of the foundation 30 by a central concrete portion 32. One of the foundation elements 2 is show in FIG. 3. The foundation elements 2 each comprise an elongated body 4. At a first end 6 of the elongated body 4 at least one bar 16 extends from the elongated body 4. The at least one bar 16 of each foundation element 2 of the foundation 30 are joined by the central concrete portion 32.

The foundation 30 is arranged in the ground with a first end surface 10 substantially at ground level. Each foundation element 2 is provided with a through hole 22 extending through the elongated body 4. A pile 34 extends through the through hole 22. The pile 34 is secured in the through hole 20 by a concrete filling 36. Thus, in addition to the foundation 2 providing a wide footprint, the foundation 30 is anchored to the ground by means of the piles 34 to provide a stable foundation for the antenna mast 31. The pile 34 is an expandable steel pile, i.e. the pile 34 is driven into the ground in the form of a substantially uniform diameter steel tube. Thereafter an expander device is lowered into the pile 34 and is activate to expand a portion 38 of the pile 34. In this manner the pile 34 is solidly anchored in the ground. Further piles of the foundation 30 may be of the same kind as pile 34 or of one or more different kinds than pile 34.

Each foundation element 2 is provided with attachment arrangements 18. The antenna mast 31 is attached to the foundation by means of the attachment arrangements 18. The attachment arrangement 18 may comprise at least one threaded shaft 20 and nut 40.

Figure 4:
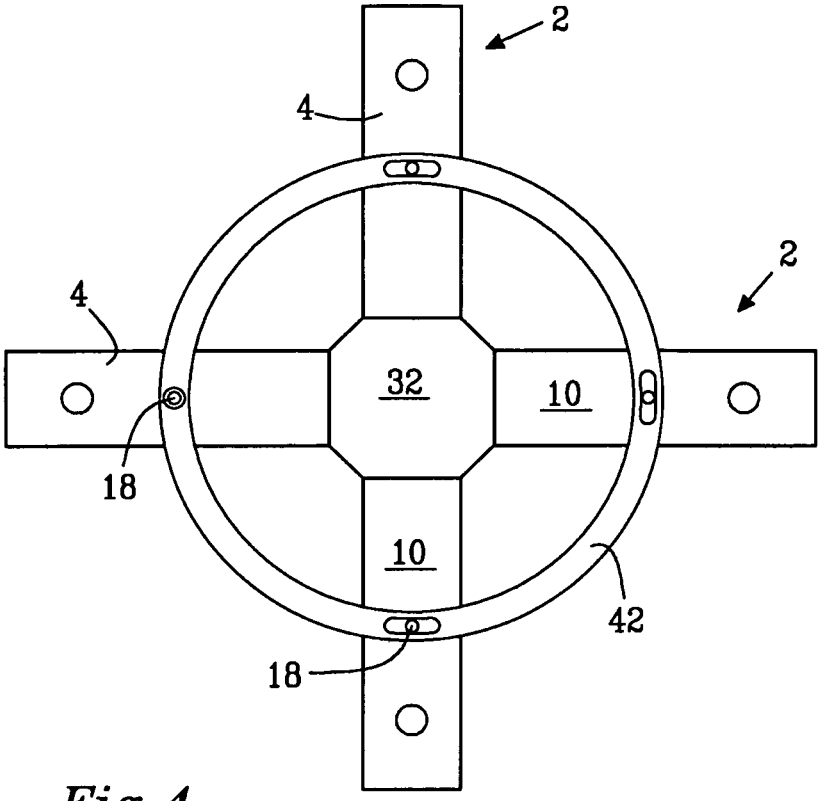
FIG. 4 illustrates a foundation for an antenna mast of a wireless communication system according to embodiments.

FIG. 4 illustrates a foundation 30 for an antenna mast of a wireless communication system according to embodiments. The foundation 30 comprises four foundation elements 2 comprising elongated bodies 4, which foundation elements 2 are joined by a central concrete portion 32. The foundation elements 2 may be designed in accordance with aspects and embodiments disclosed herein. In particular, the elongated bodies 4 each have a first side surface 10 facing upwardly and an attachment arrangement 18 for the antenna mast.

A template 42 is illustrated FIG. 4. The template 42 may be used for positioning the foundation elements 2 symmetrically and/or for placing the first side surfaces 10 of the four foundation elements 2 in the same horizontal plane. The template 42 is provided with one or more slots and/or holes for mating with the attachment arrangements 18. The template 42 is used during the building of the foundation 30 and may be removed once it has been verified that the four foundation elements 2 are correctly positioned and/or level.

Figure 5:
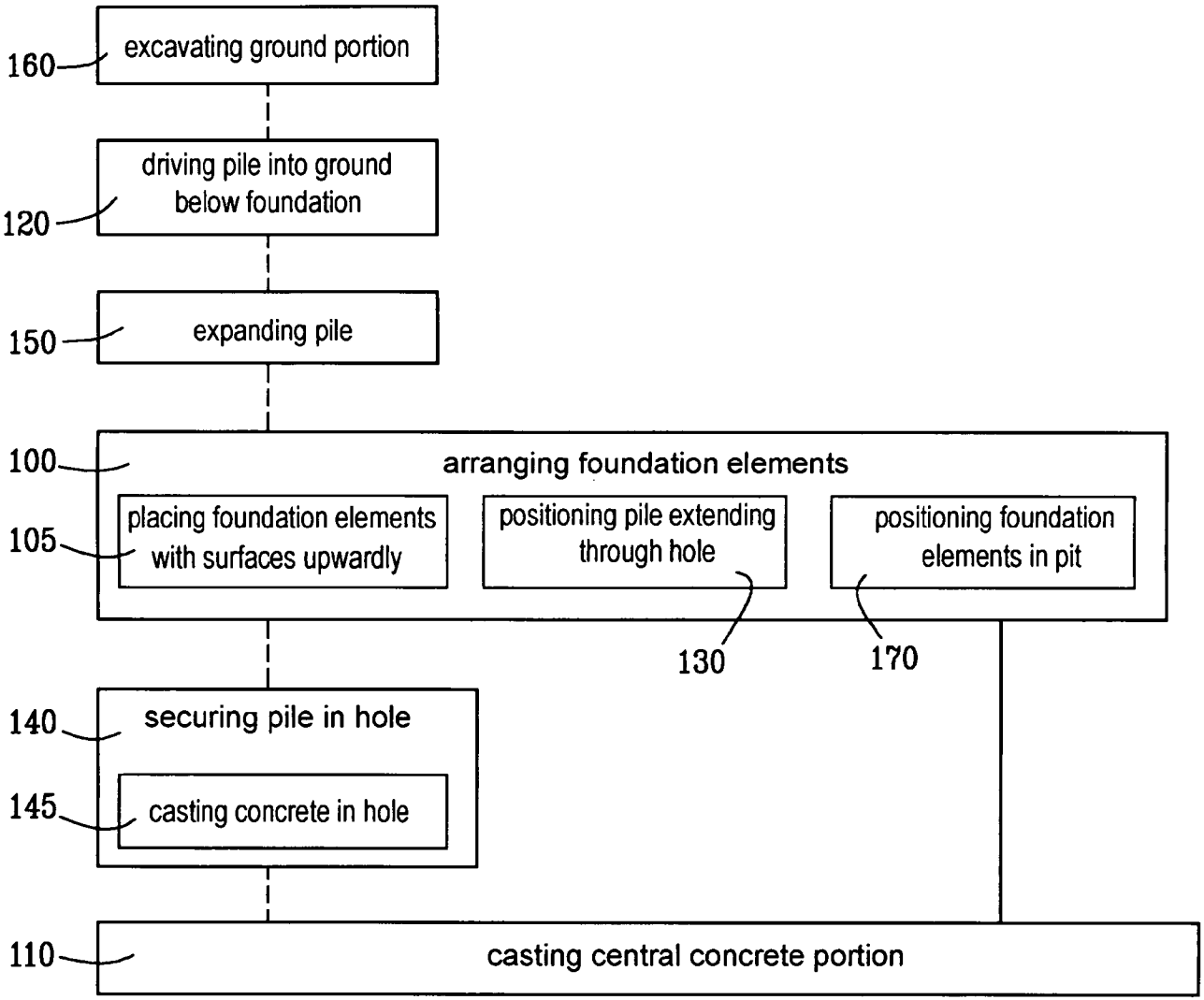
FIG. 5 illustrates a method of building a foundation for an antenna mast of a wireless communication system.

FIG. 5 illustrates a method of building a foundation for an antenna mast of a wireless communication system. The foundation comprises at least three foundation elements. Each foundation element comprises an elongated body. The elongated body comprises a first end, a second end and is provided with a first end surface. At least one bar extends from the elongated body at the first end. An attachment arrangement for the antenna mast extends from the first end surface. The method comprises:

arranging 100 the at least three foundation elements to extend substantially symmetrically from a central portion of the foundation and such that each of the first ends of the at least three foundation elements is arranged at the central portion of the foundation, and casting 110 a central concrete portion in the central portion of the foundation to join the at least one bar of each of the three foundation elements.

According to embodiments the arranging 100 may comprise:

placing 105 each of the at least three foundation elements with the first end surfaces facing upwardly.

According to embodiments the elongated body of each of the at least three foundation elements may be provided with a through hole extending through the first end surface. The method may further comprise:

driving 120 one pile for each foundation element into a ground portion below the foundation, the arranging 100 may comprise:

positioning 130 each pile to extend through each through hole of the at least three foundation elements, and the method may further comprise:

securing 140 each pile in each through hole. The driving 120 may be performed before the positioning 130. Alternatively, the driving 120 may be performed after the positioning 130.

According to embodiments, the securing 140 may comprise:

casting 145 concrete in the through hole of each foundation element. The casting 145 may be performed when the casting 110 is performed.

According to embodiments the method may further comprise:

expanding 150 each pile after it has been driven into the ground portion.

According to embodiments the method may further comprise:

excavating 160 a ground portion to form a pit arranged to receive the at least three foundation elements to extend substantially symmetrically from the central portion of the foundation, and the arranging 100 may comprise:

positioning 170 each of the at least three foundation elements in the pit with its first end surface substantially at, or above, ground level.

Although reference has been made to example embodiments, many different alterations, modifications and the like will become apparent for those skilled in the art. For example, the central concrete portion 32 may be cast in a mould built from removable mould elements arranged in connection with the foundation elements 2. Alternatively, the pit 26 may be filled around the foundation elements 2 except for in the central portion 24 of the foundation and the central concrete portion is cast directly in the central portion 24 with surrounding soil used as a mould keeping the concrete in place during curing. One or more piles of a different kind than discussed in connection with FIG. 3 may be used.

Therefore, it is to be understood that the foregoing is illustrative of various example embodiments and is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting. As used herein, the singular forms "a", "an" and "the" are intended to include the plural forms as well, unless the context clearly indicates otherwise.

It will be understood that although the terms first, second, third etc. may be used herein to describe various elements, components, regions, layers and/or sections, these elements, components, regions, layers and/or sections should not be limited by these terms. These terms are only used top distinguish one element, component, region, layer or section from another element, component, region, layer or section. Thus, a first element, component, region, layer or section discussed herein could be termed a second element, component, region, layer or section without departing from the teachings herein.

Example embodiments have been described herein with reference to cross-section illustrations that are schematic illustrations of idealized embodiments (and intermediate structures). As such, variations from the shapes of the illustrations as a result, for example, of manufacturing techniques and/or tolerances are to be expected. Thus, embodiments should not be construed as limited to the particular shapes of regions illustrated herein but are to include deviations in shape that result, for example, from manufacturing.

The invention claimed is:

1. A foundation for an antenna mast of a wireless communication system comprising:

at least three foundation elements, each foundation element comprising an elongated body, the elongated body comprising a first end, a second end and being provided with a first end surface, wherein at least one reinforcement bar extends from the elongated body at the first end and at least one threaded shaft for the antenna mast to be supported by the foundation extends from the first end surface towards the antenna mast, and wherein the elongated body is provided with a through hole extending through the first end surface;

wherein the at least three foundation elements are arranged to extend substantially symmetrically from a central portion of the foundation;

wherein each of the first ends of the at least three foundation elements are arranged at the central portion of the foundation, so that the at least one reinforcement bar extending from the first end of each foundation element extends into the central portion of the foundation;

wherein the reinforcement bars extending from the first ends of the at least three foundation elements are joined together by a central concrete portion that is cast in place in the central portion of the foundation after arranging the at least three foundation elements around the central portion of the foundation; and wherein a pile extends through each through hole of the at least three foundation elements and each pile is secured in each through hole by a concrete filling.

2. The foundation according to claim 1, wherein at least one of the piles is an expandable steel pile.

3. The foundation according to claim 1, wherein the elongated body comprises concrete.

4. The foundation according to claim 1, wherein the through hole extends substantially in parallel with a second end surface through the elongated body, wherein the second end surface is substantially perpendicular to the first end surface.

5. The foundation according to claim 1, wherein the at least one threaded shaft is secured in the elongated body.

6. The foundation according to claim 1, wherein the at least one threaded shaft is cast into the elongated body and protrudes from the first end surface towards the antenna mast.

* * * * *